US006609460B2

(12) United States Patent
Lötsch

(10) Patent No.: US 6,609,460 B2
(45) Date of Patent: Aug. 26, 2003

(54) CYLINDER FOR RECEIVING A PRINTING FORM INCLUDING CYLINDER GAP WITH CURVED GAP EDGES

(75) Inventor: Kurt Lötsch, Wiesenbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/000,693

(22) Filed: Nov. 15, 2001

(65) Prior Publication Data

US 2002/0059878 A1 May 23, 2002

Related U.S. Application Data

(60) Provisional application No. 60/248,934, filed on Nov. 15, 2000.

(51) Int. Cl.[7] ..... B41F 31/06; B41F 13/16

(52) U.S. Cl. ..... 101/415.1; 101/477; 101/378

(58) Field of Search ..... 101/415.1, 401.1, 101/477, 142, 212, 216, 378, 382.1; 399/161; 242/538.3, 538.2

(56) References Cited

U.S. PATENT DOCUMENTS 3,008,410 A * 11/1961 Bryer ..... 101/415.1
3,166,012 A * 1/1965 Hantscho ..... 101/220
4,231,652 A 11/1980 Moser et al. ..... 399/161
4,466,349 A * 8/1984 Bartlett ..... 101/220
4,575,890 A * 3/1986 Hidle ..... 15/104.002
5,622,111 A * 4/1997 Bachmeir et al. ..... 101/415.1
5,673,623 A * 10/1997 Schmid ..... 101/415.1
5,809,881 A * 9/1998 Deschner et al. ..... 101/132

FOREIGN PATENT DOCUMENTS

| | | |
|---|---|---|
| DE | 2720673 | 11/1978 |
| DE | 2756388 | 6/1979 |
| DE | 4224332 A1 | 1/1994 |
| DE | 4329125 C1 | 1/1995 |
| DE | 4429210 | 2/1996 |

* cited by examiner

*Primary Examiner*—Leslie J. Evanisko
(74) *Attorney, Agent, or Firm*—Lawrence A. Greenberg; Werner H. Stemer; Ralph E. Locher

(57) ABSTRACT

A cylinder for receiving a printing form, the cylinder being formed with a gap having gap edges, which projects into the interior of the cylinder, the gap extending in a direction of generatrices of the cylinder and serving for guiding ends of a printing form therethrough, includes device for tautening the printing form on a jacket surface of the cylinder, at least one of the gap edges having a curvature for attaining tensioning forces which are constant over at least approximately the entire width of the printing form.

2 Claims, 2 Drawing Sheets

CYLINDER FOR RECEIVING A PRINTING FORM INCLUDING CYLINDER GAP WITH CURVED GAP EDGES

CROSS-REFERENCE TO RELATED APPLICATION

This application claims the benefit under 35 U.S.C. § 119(e) of provisional application No. 60/248,934, filed Nov. 15, 2000.

BACKGROUND OF THE INVENTION

Field of the Invention

The invention relates to a cylinder for receiving a printing form, in particular for receiving a printing film for offset printing.

Heretofore known printing form cylinders have systems therewithin for winding printing film onto reels or spools and for unwinding the printing film therefrom. Starting from the wind-up reel, the film is guided outwardly through a slit-like gap. The film is looped around the outer or jacket surface of the cylinder and is led back through the same gap or another gap into the interior of the cylinder and onto the wind-up reel. In this regard, an effort is made to apply tension to or tauten the film uniformly on the cylinder, for which purpose high tension forces take effect in order to overcome the friction between the film underside and the jacket surface (note German Patent 27 56 388 and published German Patent Documents DE 42 24 332 A1 and DE 43 29 125 C1).

A disadvantage of the heretofore known procedures is that, despite high tension forces, the film is seated movably on the jacket surface of the printing form cylinder. This results, during printing, in wearing of the film and in printing errors.

SUMMARY OF THE INVENTION

It is accordingly an object of the invention to provide a cylinder for receiving a printing form which, at relatively little outlay, allows a printing form to be tautened uniformly and without any movement.

With the foregoing and other objects in view, there is provided, in accordance with the invention, a cylinder for receiving a printing form, the cylinder being formed with a gap having gap edges, which projects into the interior of the cylinder, the gap extending in a direction of generatrices of the cylinder and serving for guiding ends of a printing form therethrough, comprising a device for tautening the printing form on a jacket surface of the cylinder, at least one of the gap edges having a curvature for attaining tensioning forces which are constant over at least approximately the entire width of the printing form.

In accordance with another feature of the invention, the curvature, in the circumferential direction of the cylinder, projects in the region of the center of the printing form and recedes in side regions of the printing form.

In accordance with a further feature of the invention, the tautening device acts at both ends of the printing form, both of the gap edges having a cambered form, and being spaced apart a distance is reduced in the region of the center of the printing form, and increases continuously towards side regions of the printing form.

In accordance with an added feature of the invention, the gap edges are rounded.

In accordance with an additional feature of the invention, the gap edges have a low coefficient of friction.

In accordance with a concomitant feature of the invention, the cylinder includes roller elements for at least partly carrying the printing form, the roller elements serving for reducing the friction along the curved gap edges.

Due to the curved form of at least one of the gap edges of a cylinder, it is possible to mount a printing form, in particular a printing film, in tension on the outer or jacket surface of the cylinder, so that there is substantially uniform tension in the printing form over the width thereof.

Other features which are considered as characteristic for the invention are set forth in the appended claims.

Although the invention is illustrated and described herein as embodied in a cylinder for receiving a printing form, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
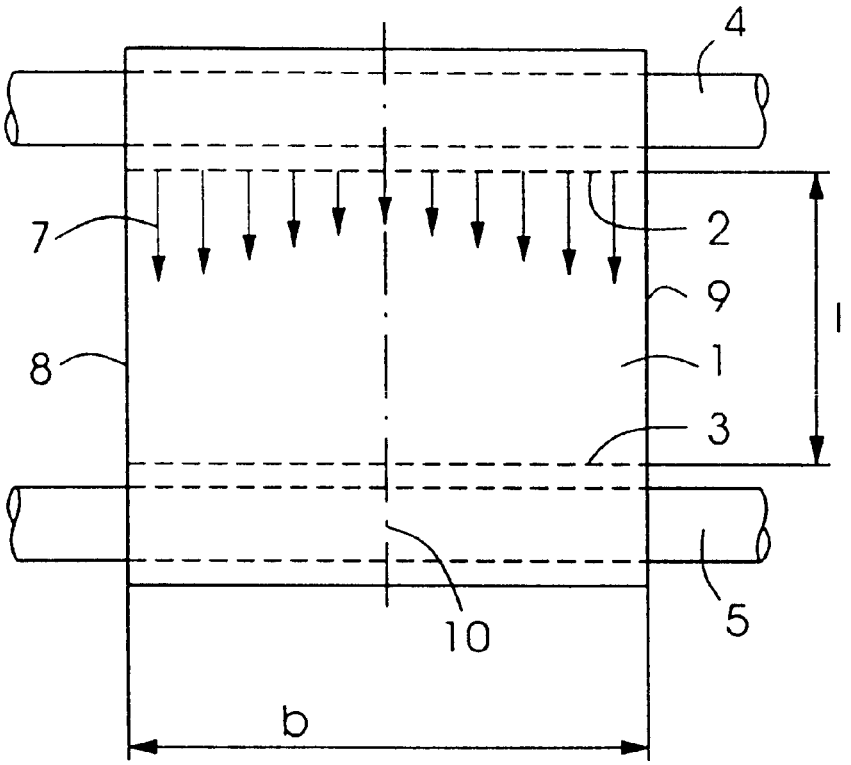
Fig.1 PRIOR ART
FIG. 1 is a diagrammatic plan view of a cylinder with rectilinear gap edges, which also shows the tension or force distribution in a printing film.

Referring now to the drawings and, first, particularly to FIG. 1 thereof, there is shown therein diagrammatically the tension or force distribution in a printing film 1 in the case of a printing form cylinder having rectilinear gap edges 2 and 3. A region of the printing film 1 having a length 1 and a width b lies developed or projected into a plane between the gap edges 2 and 3 on the outer or jacket surface of the cylinder. The printing film 1 is tautened between an unwinding roller 4 and a wind-up roller 5 over the gap edges 2 and 3. In this regard, the wind-up roller 5 can be coupled to a motor, and the unwinding roller 4 to a braking device. FIG. 1 further shows the tension distribution in the printing film 1 along the width b. The tension vectors 7 extend in the circumferential direction of the cylinder. The tension vectors 7 are greater in the vicinity of the edges 8 and 9 of the printing film 1 than in the environment of the center line 10 of the printing film 1. A consequence of this nonuniform tension distribution is that the printing film 1 adheres less firmly to the outer or jacket surface of the cylinder in the environment of the center line 10 than in the vicinity of the edges 8 and 9. When interacting with a further cylinder, the printing film 1 may slip on the jacket surface, which may lead to register errors during printing. The printing form cylinder ought not to have any dimensional deviations in the radial direction, so that no compensation for the nonuniform tension distribution in the radial direction is possible.

Figure 2:
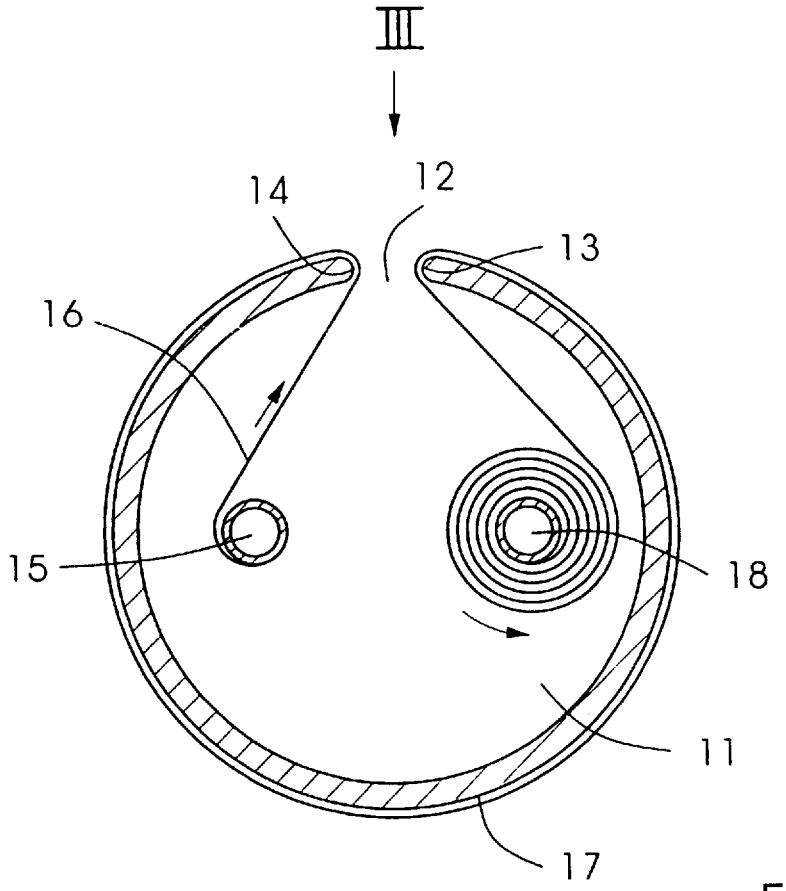
FIG. 2 is a cross-sectional view of a cylinder having cambered gap edges.
Figure 3:
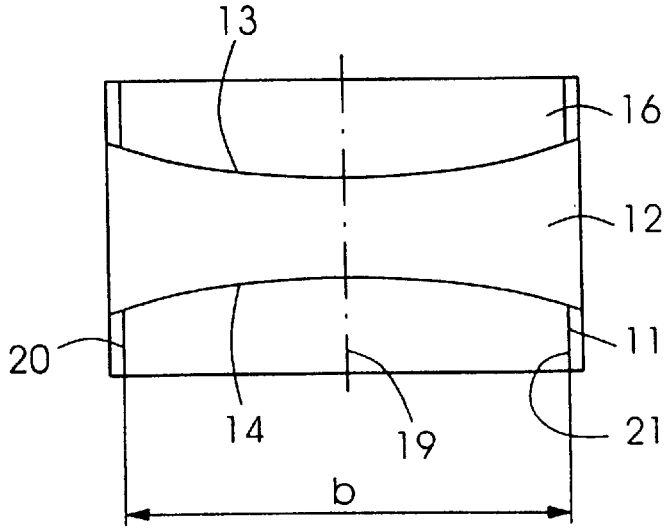
FIG. 3 is a view of FIG. 2 taken in the direction of the arrow III and rotated counterclockwise through 90°.

Compensation for the different tensions is achieved by providing cambered gap edges, as is illustrated in greater detail in FIGS. 2 and 3. FIG. 2 is a cross-sectional view of a cylinder 11 with a gap 12 having gap edges 13 and 14. A stock reel 15 for printing film 16 is located within the cylinder 11. The web-like printing film 16 is guided, starting from the stock reel 15, through the gap 12 over the gap edge 14, and is looped around the jacket surface 17 of the cylinder 11. The other end of the printing film 16 is guided over the gap edge 15 and the gap 12 into the interior of the cylinder 11 and onto a wind-up reel 18.

As viewed in the direction of the arrow III in FIG. 2 and rotated 90° counterclockwise, FIG. 3 shows the cambered or curved construction of the gap edges 13 and 14. The curvatures of the gap edges 13 and 14 project in the region of the center line 19 of the printing film 16 which is disposed symmetrically onto the jacket surface 17 of the cylinder 11.

The gap 12 is narrowed in this region. The gap edges 13 and 14 are set back in the direction of the edges 20 and 21 of the printing film 16, so that the gap 12 is wider thereat than in the center. The curvature dimension for the gap edges 13 and 14 is derived from the correction values necessary for uniform tension distribution. Uniform tension distribution is attained when, in the case of cambered gap edges 13 and 14, the tensile forces on the printing film 16 are correctively increased in the environment of the center line 19, as compared with the edge regions. The tensile forces may be generated in a conventional manner by a wind-up drive which is coupled to the wind-up reel 18. As noted hereinbefore, during tautening or tensioning, the stock reel may be coupled to a braking device or blocked by the wind-up drive.

The positive effect of the tension compensation occurs even when only one of the gap edges 13 and 14 is cambered. In order to improve the tensioning operation, measures may be taken which reduce the friction of the printing film 16 on the outer or jacket surface 17 and over the gap edges 13 and 14. For example, the gap edges 13 and 14 may be rounded and may be designed to have low friction. Furthermore, roller elements may be used, via which the printing film 16 is guided to the gap edges 13 and 14, the roller elements assuming the convex shape of the gap edges 13 and 14. In the case of cylinders having a plurality of gaps 12, the gap edges 13 and 14 may uniformly be cambered, as described hereinbefore.

I claim:

1. A cylinder for receiving a printing form, comprising:

a cylinder body having a jacket surface, a gap formed in said cylinder body projecting into an interior of said cylinder body and gap edges, said gap edges extending in a direction of generatrices of said cylinder body and serving for guiding ends of the printing form through said gap, at least one of said gap edges having a curvature for attaining constant tensioning forces over at least approximately an entire width of the printing form, said curvature, in a circumferential direction of said cylinder body, projecting in a region to a center of said cylinder body and receding in side regions of said cylinder body; and a device for tautening the printing form on said jacket surface.

2. A cylinder for receiving a printing form, comprising;

a cylinder body having a jacket surface, a gap formed in said cylinder body projecting into an interior of said cylinder body and gap edges, said gap edges having a cambered form and extending in a direction of generatrices of the cylinder body for guiding ends of the printing form through said gap, and said gap edges being spaced apart at a distance reduced in a center of said cylinder body and increasing continuously toward a side region of said cylinder body; and a device for tautening the printing form on said jacket surface, said tautening device acting on both ends of the printing form.

* * * * *